US009638186B1

(12) United States Patent
Xia

(10) Patent No.: US 9,638,186 B1
(45) Date of Patent: May 2, 2017

(54) ROTARY PUMP AND ROTARY MOTOR

(71) Applicant: Zhong Ai Xia, Pittsburgh, PA (US)

(72) Inventor: Zhong Ai Xia, Pittsburgh, PA (US)

( * ) Notice: Subject to any disclaimer, the term of this patent is extended or adjusted under 35 U.S.C. 154(b) by 0 days.

(21) Appl. No.: 14/968,978

(22) Filed: Dec. 15, 2015

(51) Int. Cl.

| | |
|---|---|
| ***F01C 1/336*** | (2006.01) |
| ***F01C 1/30*** | (2006.01) |
| ***F04C 2/324*** | (2006.01) |
| ***F04C 2/336*** | (2006.01) |
| ***F04C 2/30*** | (2006.01) |
| ***F04C 18/336*** | (2006.01) |
| ***F04C 18/30*** | (2006.01) |
| ***F04C 2/344*** | (2006.01) |
| ***F01C 1/344*** | (2006.01) |

(52) U.S. Cl.
CPC ..... *F04C 2/3445* (2013.01); *F01C 1/3445* (2013.01)

(58) Field of Classification Search
USPC ..... 418/268, 266, 267, 133, 225, 166
See application file for complete search history.

(56) References Cited

U.S. PATENT DOCUMENTS

| | | | | |
|---|---|---|---|---|
| 3,193,190 | A * | 7/1965 | Lindberg | F04C 18/344 418/131 |
| 3,437,079 | A * | 4/1969 | Odawara | F01C 1/3441 123/143 R |
| 5,163,825 | A * | 11/1992 | Oetting | F01C 1/44 418/153 |
| 8,047,824 | B2 * | 11/2011 | Boskovic | F01C 1/348 418/111 |
| 8,182,248 | B2 * | 5/2012 | Cygnor | F01C 21/02 384/122 |

* cited by examiner

*Primary Examiner* — Kenneth Bomberg
*Assistant Examiner* — Deming Wan

(57) ABSTRACT

A rotary vane pump or rotary vane motor including a rotatable rotor being eccentrically arranged within a rotatable cylindrical housing sleeve defining a freely rotary working chamber which takes out the relative sliding movement and friction inside to outer housing bearing. A partition element of a vane hingedly attached to the rotor; wherein the partition element travels with the rotor following the orbit of the housing incident to the expansion and contraction of the working space performing as a true dynamic radial seal; The rotor assembly along with the housing assembly being sandwiched between end-plates to fulfill dynamic side seal; The end-plates may contain pressure and non-pressure ports as well as holes for shaft, bearings, brackets and mounting hardware.

1 Claim, 2 Drawing Sheets

ROTARY PUMP AND ROTARY MOTOR

CROSS-REFERENCE TO RELATED INVENTIONS (Not Applicable)

STATEMENT REGARDING FEDERALLY SPONSORED RESEARCH OR DEVELOPMENT (Not Applicable)

BACKGROUND OF THE INVENTION (1) Field of the Invention

U.S. CLASS 418, Rotary Expansible Chamber Devices

U.S. CLASS 418/225

(2) Description of Related Art

Rotary pumps and rotary motors have some major limitations, e.g. radial friction between the moving parts and housing wall would cause significant frictional loss and unacceptable wear so the device was inefficient and won't last long.

Furthermore, a rotary machine to replace the conventional piston-crankshaft engine was a long time effort since James Watt's three-vane rotary of 1782, including Felix Wankel in the 1950s and US patent 2008/0310985 A1 by Sorby Reider dated December 2008; but unfortunately none of them succeeded as expected.

By analyzing all the prior designs, the problems were largely caused by the dynamic sealing for a variable enclosed space, and friction between the housing and moving parts.

So nevertheless how attractive could be the promises and advantages, unless these difficulties are overcome, the rotary engine was always a delusion to all inventors, for a couple of hundred years in the past.

BRIEF SUMMARY OF THE INVENTION

This is an effort to solve the sealing and friction issues with regard to rotary pumps and rotary motors, ready for the construction of a new type of rotary IC engine, by adopting:

- a housing assembly with a rotatable cylindrical sleeve to freely revolve around the inside rotating parts, so that the radial solid-to-solid sliding movement and friction therebetween is substantially avoided;
- a cylindrical rotor mounted on a straight shaft with bearings on both ends, eccentrically arranged within the rotating housing;
- a partition element of a vane being able to travel with the rotor and follow the housing orbit incident to the expansion and contraction of the working chamber, and also performs a true and responsive radial sealing as a dynamic check valve between housing chamber and inside rotating parts;
- the rotor assembly along with the housing assembly being sandwiched between end-plates which contain pressure and non-pressure ports to communicate duly with respective high and low pressure zones of the working chambers.

BRIEF DESCRIPTION OF THE SEVERAL VIEWS OF THE DRAWING(S)

DETAILED DESCRIPTION OF THE INVENTION

Figure 1:
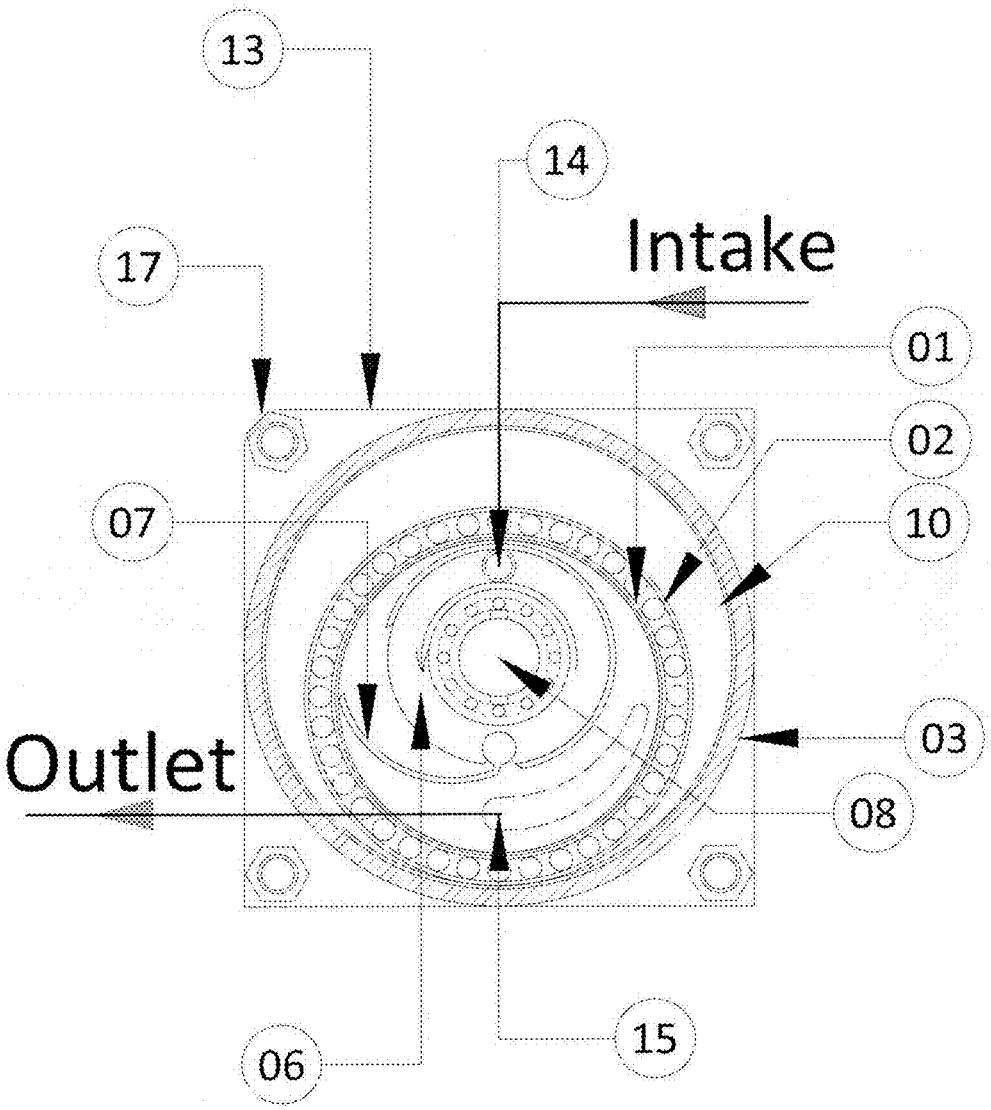
FIG. 1 is a schematic partial section view of a rotary vane motor.
Figure 2:
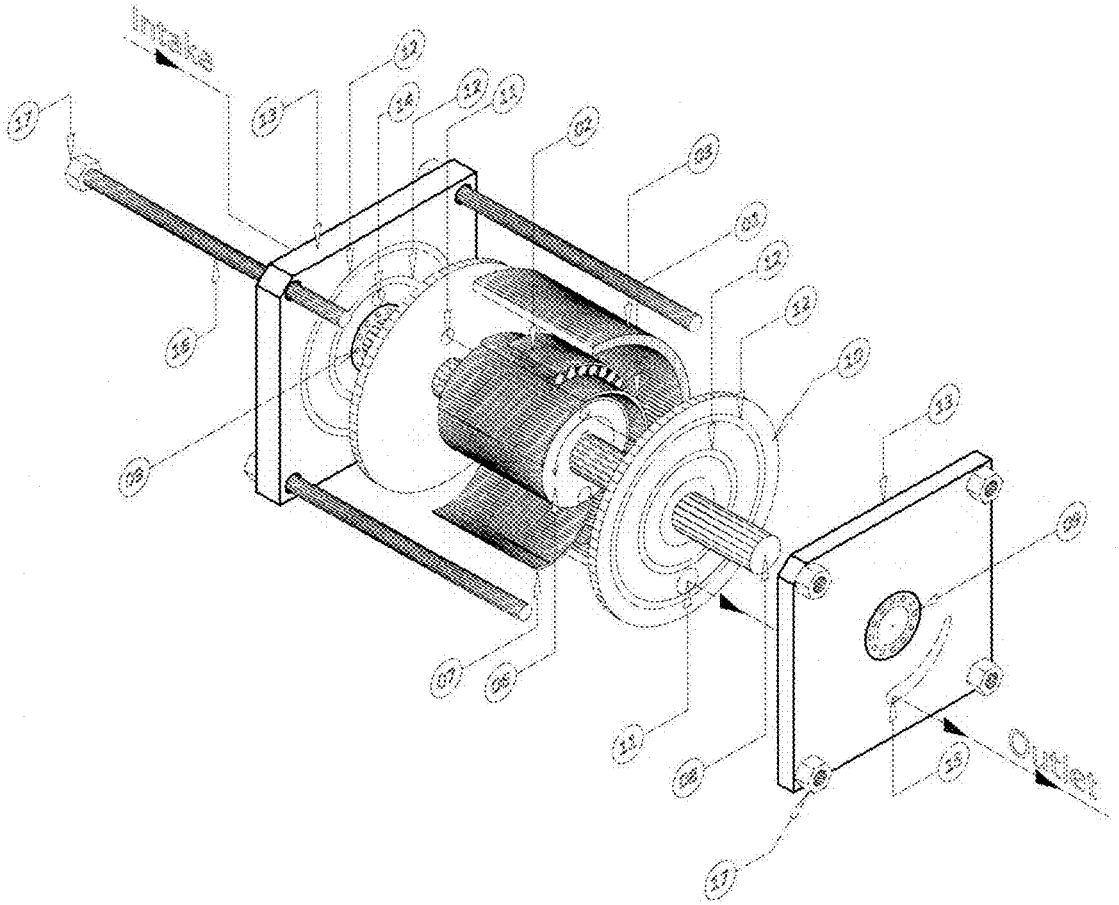
FIG. 2 is a perspective exploded view with partial section for a rotary vane motor.

A rotary machine to replace the conventional reciprocating piston-crankshaft engine is a long felt need as the potential advantages are so attractive, but nobody is successful beyond the stage of experimental prototype with poor performance, because of the difficulties to obtain both desired characteristics, in a simple and effective structure:

- perfect dynamic sealing for enclosed working space, and
- least friction between the housing chamber surface and inside rotating parts.

Performance Comparison Regarding Sealing and Friction:

| | performance expectation | |
|---|---|---|
| Comparing designs below | Sealing between working member and housing wall, radial portion for rotary: | Friction between working member and housing wall, radial for rotary: |
| Conventional piston-crankshaft machines | fair with piston ring | reasonable |
| Sliding vane rotary | difficult, tend to fail on working pressure and wear-out | significant, increasing on sealing strength and working pressure |
| Felix Wankel in the 1950s | difficult, worsening on working pressure and wear-out, tend to fail | significant, increasing on sealing strength and working pressure |
| James Watt's three-vane rotary of 1782 | none before vane contacting housing | significant while vane sliding on housing wall |
| US patent 2008/0310985 A1 by Sorby Reider | very good if disregarding vane tip roller, but tends to fail as working parts worn-down too soon | very significant while most portion of vanes sliding on housing wall under working pressure, also rotor part sliding on stator part |
| The present application | perfect as check valve | substantially avoided while housing sleeve rotating around inside rotating parts. |

PARTS LIST

01 Housing sleeve
02 Housing bearing
03 Housing Frame
04 (cancelled)
05 (cancelled)
06 Rotor for vane, see FIGS. 3, 4
07 Vane, see FIGS. 3, 4
08 Shaft
09 Shaft bearing
10 Side disk
11 Fluid passage
12 Side sealing rings
13 End-plates
14 Pressure port
15 Non-pressure port

16 Mounting bolts
17 Mounting Nuts
The present application provides components of:
a housing assembly including
a cylindrical sleeve 01 surrounded by
housing bearing 02, and
housing frame 03;
where the sleeve 01 has a revolution axis defining a rotary working space and a working orbit;
where the housing sleeve 01 is able to correspondingly rotate around all inside rotating parts including Rotor 06 and Vane 07, therefore the relative movement and friction therebetween is transferred to and borne on the outer housing bearing 02;
a rotor assembly including a rotor having a rotating axis mounted on
a straight shaft 08 with
shaft bearings 09 on both ends,
where the rotor is eccentrically arranged within the housing sleeve;
where the rotor axis and housing axis is parallel and apart from each other to form a working chamber,
and a replaceable working partition element to separate the low and high pressure zones of the working chamber, can be seen in FIGS. 3, 4:
a vane 07 hingedly attached to the periphery of
rotor 06;
wherein the partition element vane 07 is able to move or flip, to-and-fro radially relative to the rotor axis incident to the expansion and contraction of the working chamber while traveling with the rotor and follow the orbit of the housing;
while the partition element vane 07 engages the housing inner surface under working pressure, a true radial sealing is formed as a dynamic check valve between the partition element vane 07, the rotor 06 and the housing sleeve 01 inner surface;
the rotor assembly including the rotor, the partition element and
side-disks 10 with fluid passage 11, and
side sealing rings 12,
along with the housing assembly being sandwiched between end-plates 13
to complete the side sealing axially; where the end-plates may contain
pressure port 14, and
non-pressure port 15;
wherein the pressure and non-pressure port communicates timely with respective high and low pressure zones of the working chamber;
where the endplates also contain holes or cavities for
shaft 08,
shaft bearings 09,
mounting bolts 16, and
mounting nuts 17.

The invention claimed is:
1. A rotary vane pump or motor comprises:
a housing assembly including a cylindrical housing sleeve surrounded by housing bearing and housing frame;
wherein the cylindrical housing sleeve having a housing axis of revolution, defining a rotating working space and a working orbit;
a rotor assembly including a rotor, a single vane and side-disks with fluid passage, along with the housing assembly and side sealing rings being sandwiched between end-plates to fulfill the side sealing axially;
wherein the rotor having a rotor axis as the rotor mounted on a straight shaft with shaft bearings on both ends,
wherein the rotor being eccentrically positioned within the cylindrical housing sleeve to form a working chamber such that the rotor axis and the housing axis being parallel and spaced apart from each other;
the single vane being hingedly attached to the rotor periphery flipping to-and-fro relative to the rotor axis while traveling with the rotor and following the orbit of the cylindrical housing sleeve, separating high and low pressure zones of the working chamber, incident to the expansion and contraction of the rotating working space;
while the single vane engaging an inner surface of an inner wall of the cylindrical housing sleeve under working pressure, a true radial sealing being formed as a dynamic check valve therebetween;
wherein the cylindrical housing sleeve is configured to rotate accordingly around the rotor assembly including the rotor and the single vane, so that the relative sliding movement and friction between the inner wall of the cylindrical housing sleeve and the rotor assembly being conveyed to and borne on the housing bearing;
wherein the end-plates contain pressure and non-pressure port communicating duly with respective high and low pressure zones of the working chamber via passages of the side-disks and the rotor,
wherein the endplates also contain holes for the shaft, the shaft bearings, and mounting fixtures.

* * * * *